US007743737B2

(12) United States Patent
Valentine et al.

(10) Patent No.: US 7,743,737 B2
(45) Date of Patent: Jun. 29, 2010

(54) ENGINE ON PULSED FUEL ADDITIVE CONCENTRATE DOSING SYSTEM AND CONTROLLER

(75) Inventors: James M. Valentine, Fairfield, CT (US); Curtis J. Knapper, New Fairfield, CT (US)

(73) Assignee: Clean Diesel Technologies, Inc., Bridgeport, CT (US)

( * ) Notice: Subject to any disclaimer, the term of this patent is extended or adjusted under 35 U.S.C. 154(b) by 575 days.

(21) Appl. No.: 11/275,312

(22) Filed: Dec. 22, 2005

(65) Prior Publication Data

US 2006/0254535 A1 Nov. 16, 2006

Related U.S. Application Data

(60) Provisional application No. 60/639,207, filed on Dec. 23, 2004.

(51) Int. Cl.
*F02B 43/00* (2006.01)
*F02B 43/04* (2006.01)

(52) U.S. Cl. ..... 123/1 A; 123/198 A

(58) Field of Classification Search ..... 123/1 A, 123/515, 198 A; 137/1, 101.25; 222/56
See application file for complete search history.

(56) References Cited

U.S. PATENT DOCUMENTS

| | | | | |
|---|---|---|---|---|
| 4,945,880 | A * | 8/1990 | Gonze et al. | 123/674 |
| 5,195,466 | A * | 3/1993 | Schulte et al. | 123/1 A |
| 5,331,994 | A * | 7/1994 | Bryan et al. | 137/1 |
| 2004/0231615 | A1 * | 11/2004 | Vincent et al. | 123/1 A |
| 2005/0150479 | A1 * | 7/2005 | Persson | 123/333 |
| 2006/0259230 | A1 * | 11/2006 | Waters et al. | 701/115 |
| 2006/0272597 | A1 * | 12/2006 | Burrington et al. | 123/1 A |

* cited by examiner

*Primary Examiner*—Mahmoud Gimie
(74) *Attorney, Agent, or Firm*—Thaddius J. Carvis

(57) ABSTRACT

A safe, reliable system for automatically dosing diesel truck fuel tanks with a fuel additive is provided. The additive, such as a concentrated solution containing fuel borne catalyst (FBC), is fed by positive feed means in pulsed doses while the engine is on. The frequency and amount of FBC injection is controlled as a function of the time the engine is operated and predetermined values for rate of fuel consumption and intended additive concentrations in the fuel.

17 Claims, 3 Drawing Sheets

ENGINE ON PULSED FUEL ADDITIVE CONCENTRATE DOSING SYSTEM AND CONTROLLER

RELATED APPLICATIONS AND PRIORITY

This patent application claims priority to U.S. Provisional Patent Application Ser. No. 60/639,207, filed Dec. 23, 2004, the disclosure of which is hereby incorporated by reference.

BACKGROUND OF THE INVENTION

The invention provides a safe, reliable system including a controller for automatically dosing fuel with a fuel additive, using a positive feed means for injecting the additive, particularly a concentrate containing fuel borne catalyst (FBC) into the fuel, wherein the amount of FBC injection is controlled as a function of predetermined fuel consumption data. The invention has particular applicability to diesel engines of the type used in vehicle, stationary or marine applications, particularly those classified as medium duty diesel engines, but it is applicable generally where dosing of FBC or other concentrate is desired.

Fuel additives, especially FBCs containing fuel soluble or suspended compounds containing releasable catalytic metals in the form of concentrates containing platinum group metals, cerium, iron, copper, manganese, magnesium and the like or combinations, can enable cleaner burning of a fuel in an engine, thereby allowing for more efficient operation of the engine. The additives can reduce pollutants as a primary measure or in combination with an after treatment device.

Many prior art systems proposed for dosing additives involve complex monitoring electronically and/or mechanically, typically with some form of feedback control, to achieve a desired concentration of active catalytic metals in the fuel. The provision of systems that require vehicle modifications are often not practical for retrofit applications due to the great variety of trucks being used commercially, even by a single fleet owner.

Among the prior art systems are those that require operator monitoring and/or intervention. However, fleet operators need the assurance that an FBC additive concentrate is being properly added to the fuel of designated vehicles without requiring a particular operator to perform any task other than his normal operations. Operator monitoring or intervention can be problematic, especially where the same vehicle is used by different operators.

Current and proposed regulations challenge manufacturers to both achieve good fuel economy and reduce emissions. While fuel additives will likely be necessary to achieve the objectives of the regulations, the art has provided no simple device capable of metering an effective additive into the fuel in a reliable manner with no operator intervention or attention.

Automatic correctly proportioned introduction of fuel additives into the fuel tanks of vehicles on a regular, consistent basis is a challenge to fuel additive suppliers and fleet owners desiring to use them. There is a current need for a safe, economical and effective answer to the problems associated with the regular dispensing additives into the fuel.

BRIEF SUMMARY OF THE INVENTION

It is an objective of the invention to provide a safe, reliable additive dosing system for automatically introducing fuel additive into a fuel tank for the purpose of enhancing the operation of an internal combustion engine and/or reducing emission of pollutants.

It is another objective of the invention to maintain an effective average concentration of fuel additive in the fuel supply for a diesel engine.

It is another objective of the invention to eliminate any requirement that the vehicle operator monitor or activate any device on the vehicle so as to accomplish dosing of the fuel tank.

It is another objective of the invention to dose the fuel tank at a predetermined rate which corresponds to a predetermined average consumption rate.

It is another objective of invention to activate the system automatically when the engine is started and to stop it when the engine is turned off.

These and other objectives are accomplished by the invention which provides a system with process and apparatus aspects described below to automatically and positively feed fuel additive to fuel by positive feed means, delivering the fuel additive into the fuel based on a predetermined fuel consumption rate for a vehicle or type of vehicle.

In one aspect, the invention provides a method for automatically dosing a fuel additive into a fuel tank for supplying fuel to an engine, comprising: storing a fuel additive in a storage vessel having associated conduit means connecting the storage vessel and the fuel tank; sensing when the engine is on; and in response to the engine being on, positively feeding fuel additive from the storage vessel into the fuel tank in measured doses at regular, predetermined intervals and continuing introducing timed, measured doses for the time the engine is on.

In another aspect, the invention provides an apparatus for automatically dosing a fuel additive into a fuel tank for supplying fuel to an engine, comprising: storage means for storing a fuel additive; conduit means for carrying fuel additive from the storage means to a fuel tank associated with the engine; positive feed means in communication with said conduit means to feed measured amounts of said fuel additive into said conduit means; sensing means to determine when the engine is on; and means for controlling the positive feed means in response to the engine being on to deliver measured doses of additive into the fuel for the engine at regular, predetermined intervals and continuing the operation of the positive feed means for the time the engine is on.

In a preferred embodiment, the FBC is introduced into the fuel system via a typical fuel tank vent line, thereby avoiding the need to make special modifications of the tank. The invention automatically and reliably maintains an effective additive concentration in the fuel.

Preferred aspects of the invention will be described below.

BRIEF DESCRIPTION OF THE DRAWINGS

The invention will be better understood and its advantages will become more apparent when the following description is read in light of the accompanying drawings, wherein.

DETAILED DESCRIPTION OF THE INVENTION

The invention provides a safe, reliable system for automatically dosing diesel fuel tanks used in vehicle, stationary or marine applications with fuel additive, particularly a concentrate containing fuel borne catalyst (FBC) using a positive feed means as the driving force for introduction into the fuel. In the preferred form of the invention, control is achieved by sensing when the engine is started and starting a positive displacement pump at that time to deliver measured doses of additive into the fuel for the engine at regular, predetermined intervals and continuing the operation of the positive displacement pump for the time the engine is on. The delivery of pulsed doses is highly effective for maintaining desired in-tank concentrations. The measured doses and the frequency of their introduction are predetermined based on the typical fuel consumption rate for a given vehicle to maintain an average concentration in the fuel within a predetermined range, e.g., from about 1 to about 20 ppm.

Figure 1:
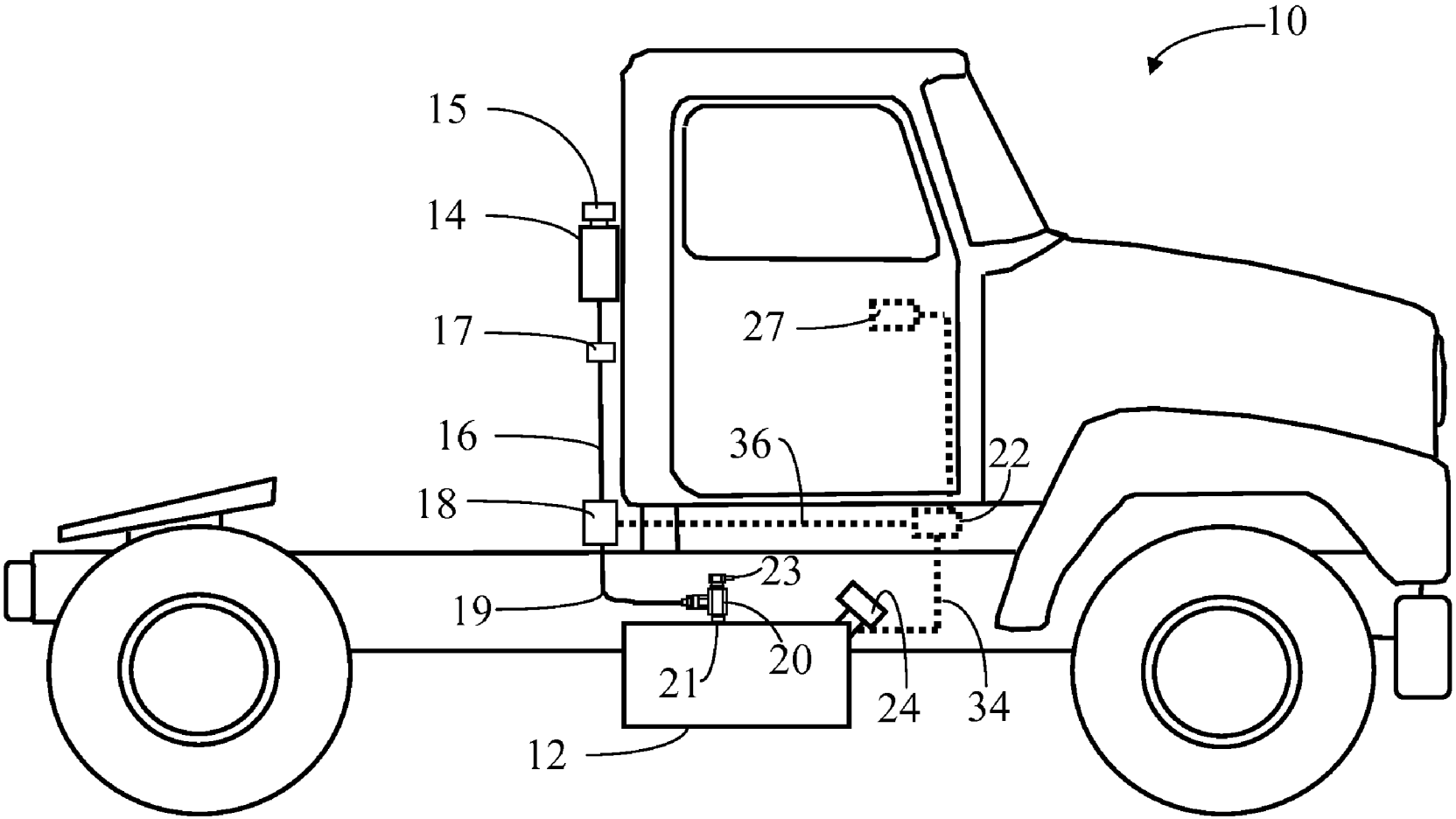
FIG. 1 is a schematic diagram of a truck having an engine-on activated additive concentrate dosing system.

The apparatus of the invention is shown in one preferred form in FIG. 1. The truck 10 has a fuel tank 12, which receives metered amounts of an FBC additive concentrate from a supply vessel 14. The supply vessel 14 has a vented cap 15 and permits feed of FBC through conduit means including line 16 and filter 17. Positive displacement pump 18 feeds FBC through conduit means including line 19 and a preferred T-fitting 20 to the tank 12, preferably a normally available tank vent.

The FBC is held in a supply vessel 14 as a concentrate in a suitable chemical form and with suitable solvents and other additives, such as described in U.S. Pat. No. 6,003,303 and the references cited therein. In one preferred form, the concentrate will have sufficient FBC to for one gallon of concentrate to treat 1500 gallons of fuel to achieve a total catalyst metal concentration in the treated fuel of abut 8 ppm, the preferred concentration.

The positive displacement pump 18 is preferably of the type including (or can be so modified) control for the length of piston stroke and/or frequency of operation. According to the preferred form of the invention, the pump will be calibrated to provide the desired, predetermined flow rates as necessary to maintain an effective concentration of FBC in the fuel. In general, the concentration for effective operation of the additive with an after treatment device such as any of those identified in U.S. Pat. Nos. 6,003,303, 5,501,714, EP 1 262 641, or the like, will be from about 1 to about 20 ppm, e.g. from about 4 to about 10 ppm, of active catalytic metal in the fuel for the preponderance of engine operation time. While the optimum dosage will not always be present, it is a feature of the invention that maintenance of the positive feed to within these guides can very effectively enhance the operation of the after-treatment device.

Figure 2:
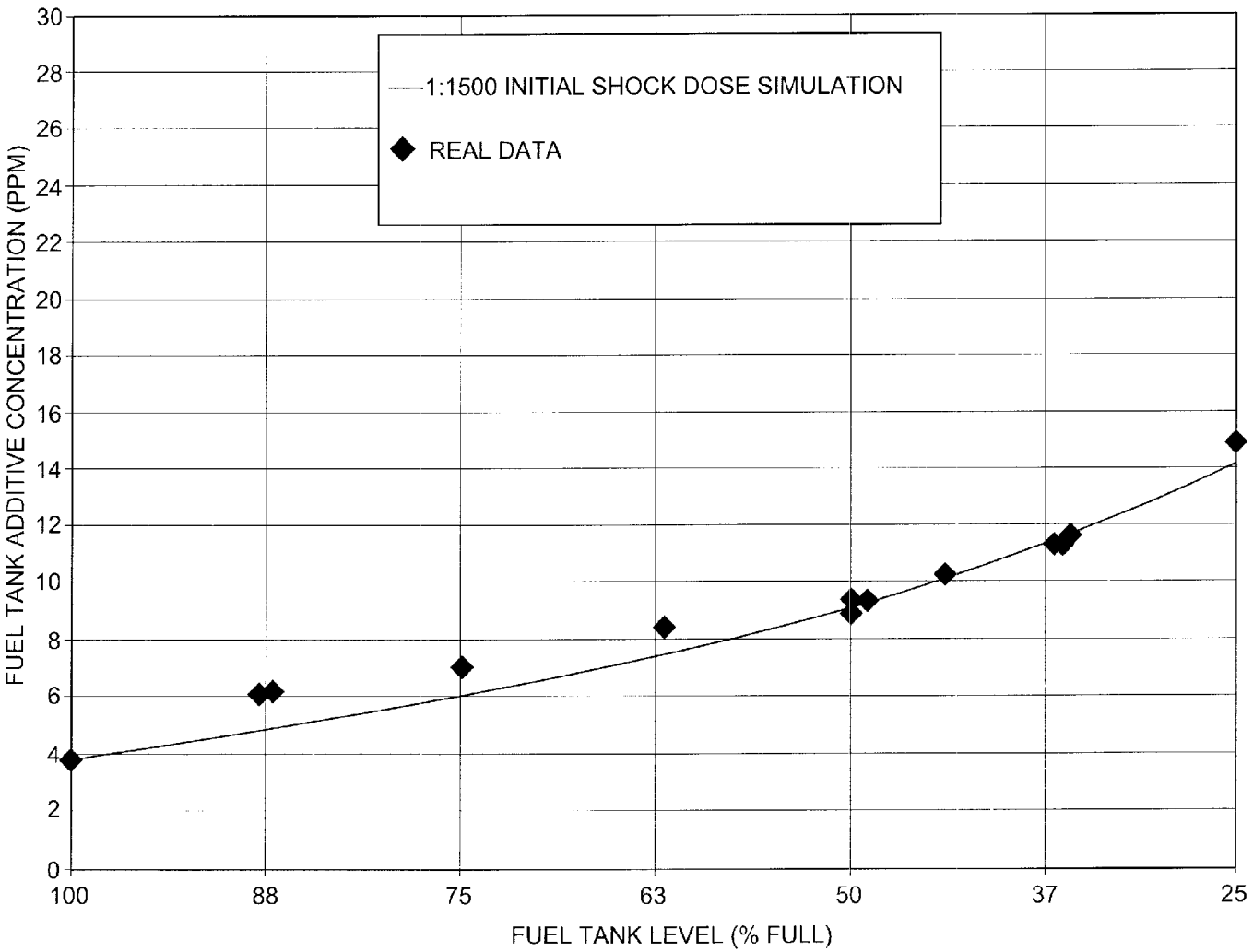
FIG. 2 is a graph showing FBC concentrations in a tank of a fleet delivery truck filled upon return to a central station where fueling occurs upon each return.

The invention has particular utility in the operation of fleet vehicles, which are brought to a central location for refueling at regular intervals, e.g., daily. FIG. 2 is a graph showing FBC concentrations in a tank of a fleet delivery truck filled upon return to a central station where fueling occurs upon each return. The concentration of the active metal (e.g., platinum and/or cerium and/or iron) FBC in fuel ranges is shown to vary between 4 and 10 ppm in this exemplary setting, with only minor variation outside this range. The invention, thus, can provide a narrow range of additive concentration in fuel as fuel level in the tank varies by correlating FBC dosing more closely to fuel consumption rates based on engine operating time. While it is not desirable, the system of the invention permits the operators to bring their trucks back with tanks near empty while not causing significant adverse effect. The data actually indicates that the concentration in the tank tends to exceed the optimum range as the tank nears empty. This is not an adverse situation. It is an advantage of the invention that by properly the monitoring fuel consumption rates for a vehicle (and programming where seen to be necessary), it is possible for the controller to maintain the concentration of catalytic metal in the fuel at the desired levels for more than a majority of the time. Preferably, the effective concentrations above will be present in the fuel tank 12 in excess of 75% of the engine operation time, and most preferably in excess of 90% of the time.

The positive displacement pump 18 is preferably a piston pump but can be of any other type, such as a peristaltic pump or the like, and is actuated by a control signal from controller 22 in response to a suitable control signal, e.g., from a sensor indicating that the engine (not shown) is on. Representative of suitable pumps are those provided, for example, by H. Daugbjerg, Denmark, as an "FBC METERING SYSTEM KIT TH-910A", but such a system would preferably be modified to introduce the FBC directly into the fuel tank 12 via line 19, as described above, not into the fuel return line. Such FBC metering pumps can include dip switches to aid programming to the desired pump stroke and frequencies based on the data on fuel consumption rate for an individual vehicle. One skilled in the art could use the description of the device as set out herein in modification of the manufacturer's directions to achieve the ends of this invention.

Figure 3:
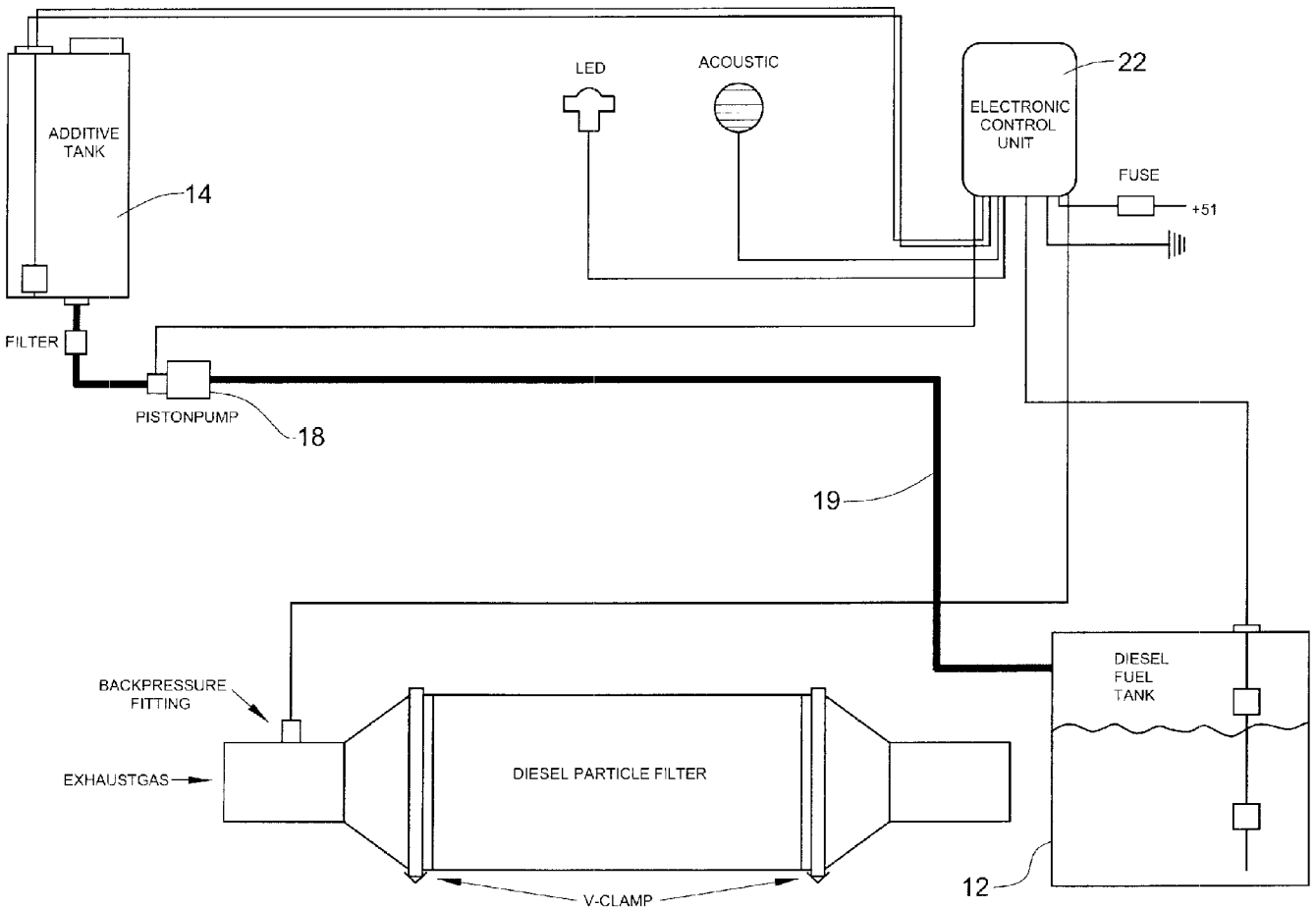
FIG. 3 is a schematic diagram of a representative apparatus with a positive displacement pump sending FBC concentrate from an additive tank to a diesel fuel tank.

As an added aid, we provide FIG. 3, which shows a representative modified apparatus as a schematic flow diagram showing a positive displacement pump sending FBC concentrate from an additive tank to a diesel fuel tank (14 and 12). The system of FIG. 3 illustrates an electronic control unit which can be designed and programmed to sense the preferred parameter of when the engine is on, but can conveniently also sense and adjust operation based on other various parameters, including engine on time, engine revolutions, amount of fuel in the tank, back pressure in a particulate filter, concentration of FBC in the fuel, position of fueling cap indicating whether it is on or off, flow of fuel into the tank, engine start and engine off, and the like. The electronic control unit can be programmed to send appropriate signals to the positive displacement pump 18 to cause it to start operation at a predefined rate, stop operation, or adjust operation by changing the stroke and/or frequency of piston operation or effect other controllable pump variables. As noted above, it is preferred to start the pump for intermittent feeding of controlled doses of FBC during the time the engine is operating.

When the positive displacement pump 18 is actuated to cycle, the FBC concentrate is caused by the pump 18 to flow to fuel tank 12 by positive, measured flow through supply line 19 and preferred T-fitting 20, which has an outlet or port 21 to the tank 12 and a vent valve 23. When the positive displacement pump 18 is actuated to be in the off position, no FBC concentrate flows to the tank. Preferably, the positive displacement pump 18 is suitably biased to be in a normally off position. That way, there must be a positive signal to operate the positive displacement pump and cause the additive to flow through lines 18 and 19 through T-fitting 20 to tank 12.

In a preferred mode of operation, once the engine is started, the pump 18 begins metering the FBC into the fuel tank 12. Average fuel consumption is known and the pump is operated at a rate effective to maintain a desired, predetermined concentration of FBC in the tank 12. Time and amount are adjustable based on typical fuel consumption. The timing and rate of injection can be controlled responsive to a control signal from an ignition key switch 27 or other indicator that the engine is running. In response to the engine being on, positive displacement pump 18 or other means will positively feed fuel additive from the storage vessel into the fuel tank in measured doses at regular, predetermined intervals and continuing introducing timed, measured doses for the time the engine is on. This type of pulsed introduction is highly effective. The system will operate effectively to supply FBC additives to other vehicles as well, but this description is described in connection with diesel trucks as the preferred use of the invention.

The FBC is introduced into the fuel system via a typical, e.g., truck, fuel tank vent line port 21. The port 21 where the fuel tank vent line is typically threaded into is fitted with a "T" type pipe fitting 20. The vent valve 23 is then threaded into the top of the T and the additive line 19 is threaded into the side of the T. This simplified arrangement allows for a positive or a gravity feed means feed of the FBC and does not require a dosing pump injecting additive into the pressurized fuel return line which is more difficult, but typical to other dosing systems.

The invention has particular utility in the operation of fleet vehicles, which are brought to a central location for refueling at regular intervals, e.g., daily. FIG. 2 is a graph showing FBC concentrations in a tank of a fleet delivery truck filled upon return to a central station where fueling occurs upon each return. The concentration of FBC in fuel range is shown to vary between 4 and 10 ppm in this exemplary setting (test data indicated as "Real Data"). The invention, thus, can provide a narrow range of additive concentration in fuel as fuel level in the tank varies by correlating FBC dosing more closely to fuel consumption based on engine operating time.

The frequency and amount of doses will be predetermined based on providing a predetermined amount of additive to the fuel based on a predetermined estimated rate of consumption. It is an advantage of the invention that predictions can be made fairly effectively and that real time monitoring has been found to be unnecessary. In the preferred case mentioned, it has been found that sufficient FBC additive concentrate can automatically flow by gravity or a positive feed means into a 66 gallon tank to provide an average fuel to concentrate weight ratio of about 1500:1 using a preferred platinum and cerium additive combination as described in U.S. Pat. No. 6,003,303, to provide a platinum concentration of about 0.15 ppm and a cerium concentration of about 8 ppm. These doses are highly effective in providing significant improvements in fuel economy for delivery trucks and to permit diesel particulate traps (DPT's) and other after treatment devices used with them to continuously operate for long periods of time to reduce particulate emissions from such trucks.

The size of the vessel 14 is desirably large enough to hold additive sufficient for a plurality of fueling stops and to run for at least a full day of operation. With a target of at least a days driving, e.g., at least about 750 miles traveled for a medium duty delivery truck, about two quart capacity will permit the vehicle operator to be free of any concern with the dispenser and for maintenance personnel to refill the vessel 14 on a daily basis. It has been found advantageous to provide a reservoir large enough to hold a supply of FBC concentrate sufficient for at least about a week of operation, and more preferably for from about 2 to about 4 weeks of operation. Other design criteria will work as well.

It is an advantage of the invention that the system can provide for gravity feed also, such as where the positive feed means is inactive. In this feature of the invention, fuel additive can be fed to fuel by gravity, utilizing a timer and a solenoid valve. In one example, once the engine is started, an optional timer means begins measuring the amount of time the engine is run. Engine operating time is used as an indictor of fuel consumption. Once the "run time" reaches a programmed value, e.g., 20 minutes, a solenoid valve will open and a preset amount of additive will be injected into the fuel. A controller can be included, which includes timer means and also includes a memory means, which will remember the run time of the engine since the last addition, so that each dose of fuel additive will be after the same predetermined period of engine run time, even if the engine is shut down one or more times before the programmed value is completed. In a preferred embodiment, an FBC or other additive is introduced into the fuel system via a typical fuel tank vent line, thereby avoiding the need to make special modifications of the tank.

The above description is for the purpose of teaching the person of ordinary skill in the art how to practice the present invention, and it is not intended to detail all of those obvious modifications and variations of it which will become apparent to the skilled worker upon reading this description. It is intended, however, that all such obvious modifications and variations be included within the scope of the present invention which is defined by the following claims. The claims cover the indicated components and steps in all arrangements and sequences which are effective to meet the objectives intended for the invention, unless the context specifically indicates the contrary.

The invention claimed is:

1. An apparatus for automatically dosing a fuel additive into a fuel tank for supplying fuel to an engine, comprising:

storage means for storing a fuel additive;

conduit means for carrying fuel additive from the storage means to a fuel tank associated with the engine;

positive feed means in communication with said conduit means to feed measured amounts of said fuel additive into said conduit means;

sensing means to determine when the engine is on; and means for controlling the positive feed means in response to the engine being on to deliver measured doses of additive into the fuel for the engine at regular, predetermined timed intervals and continuing the operation of the positive feed means at said regular, predetermined timed intervals for the time the engine is on.

2. An apparatus according to claim 1 wherein the rate of additive supply is based on average rate of fuel consumption.

3. An apparatus according to claim 1 wherein a fuel additive reservoir is provided to maintain sufficient concentrate to permit driving for from about 1 to 4 weeks of operation.

4. An apparatus according to claim 1 wherein the positive feed means comprises a positive displacement pump.

5. An apparatus according to claim 1 wherein the positive feed means is controlled to deliver predetermined doses of fuel additive to maintain a concentration of active metal in the fuel to within the range of from about 1 to about 20 ppm.

6. An apparatus according to claim 1 wherein the positive feed means is controlled to deliver predetermined doses of fuel additive to maintain a concentration of active metal in the fuel to within the range of from about 4 to about 10 ppm, for at least half of the engine operation time.

7. An apparatus according to claim 1 wherein the positive feed means is controlled to deliver predetermined doses of fuel additive to maintain a concentration of active metal in the fuel to within the range of from about 4 to about 10 ppm for at least 75% of the engine operation time.

8. An apparatus according to claim 1 wherein the additive is fed into the fuel tank though a T-fitting positioned in a tank vent, wherein one end of the T-fitting provides the tank vent, one receives additive from storage means for storing a fuel additive and one is open to the fuel tank to permit the additive to flow into it.

9. A method for automatically dosing a fuel additive into a fuel tank for supplying fuel to an engine, comprising:

storing a fuel additive in a storage vessel having associated conduit means connecting the storage vessel and the fuel tank;

sensing when the engine is on; and in response to the engine being on, positively feeding fuel additive from the storage vessel into the fuel tank in measured doses at regular, predetermined timed intervals and continuing introducing timed, measured doses for the time the engine is on.

10. A method according to claim 9 wherein the rate of additive supply is based on average rate of fuel consumption.

11. A method according to claim 9 wherein a fuel additive reservoir is provided to maintain sufficient concentrate to permit driving for from 1 to 4 weeks.

12. A method according to claim 9 wherein the positive feed means comprises a positive displacement pump.

13. A method according to claim 9 wherein the positive feed means is controlled to deliver predetermined doses of fuel additive to maintain a concentration of active metal in the fuel to within the range of from about 1 to about 20 ppm.

14. A method according to claim 9 wherein the positive feed means is controlled to deliver predetermined doses of fuel additive to maintain a concentration of active metal in the fuel to within the range of from about 4 to about 10 ppm, for at least half of the engine operation time.

15. A method according to claim 9 wherein the positive feed means is controlled to deliver predetermined doses of fuel additive to maintain a concentration of active metal in the fuel to within the range of from about 4 to about 10 ppm for at least 75% of the engine operation time.

16. A method according to claim 9 wherein the additive is fed into the fuel tank though a T-fitting positioned in a tank vent, wherein one end of the T-fitting provides the tank vent, one receives additive from storage means for storing a fuel additive and one is open to the fuel tank to permit the additive to flow into it.

17. A method for automatically dosing a fuel additive into a fuel tank for supplying fuel to an engine, comprising: storing a fuel additive in a storage vessel having associated conduit means connecting the storage vessel and the fuel tank; sensing when the engine is on; and in response to the engine being on, feeding fuel additive from the storage vessel into the fuel tank in measured doses at regular, predetermined timed intervals and continuing the operation of the positive displacement pump at regular, predetermined timed intervals for the time the engine is on.

* * * * *